United States Patent [19]

Missimer

[11] 4,176,526

[45] Dec. 4, 1979

[54] REFRIGERATION SYSTEM HAVING QUICK DEFROST AND RE-COOL

[75] Inventor: Dale J. Missimer, San Anselmo, Calif.

[73] Assignee: Polycold Systems, Inc., San Rafael, Calif.

[21] Appl. No.: 944,961

[22] Filed: Sep. 22, 1978

Related U.S. Application Data

[63] Continuation-in-part of Ser. No. 800,075, May 24, 1977, abandoned.

[51] Int. Cl.[2] ..... F25B 47/00; F25B 19/00

[52] U.S. Cl. ..... 62/278; 62/514 R

[58] Field of Search ..... 62/81, 119, 277, 278, 62/514 R

[56] References Cited

U.S. PATENT DOCUMENTS

| | | | |
|---|---|---|---|
| 2,281,770 | 5/1942 | Hoesel | 62/81 |
| 2,554,848 | 5/1951 | Warren | 62/81 |
| 2,628,479 | 2/1953 | Powers et al. | 62/162 |
| 2,630,685 | 3/1953 | Lewis | 62/81 |
| 2,710,507 | 6/1955 | Ashley | 62/81 |
| 3,071,935 | 1/1963 | Kapeker | 62/278 |
| 3,492,832 | 2/1970 | Davis et al. | 62/81 |
| 3,677,025 | 7/1972 | Payne | 62/81 |
| 3,838,582 | 10/1974 | Redfern et al. | 62/278 |
| 4,009,594 | 3/1977 | Swanson | 62/278 |

*Primary Examiner*—Lloyd L. King
*Attorney, Agent, or Firm*—Jay M. Cantor

[57] ABSTRACT

Fast defrosting and fast recooling of the evaporator coil is a refrigeration system, whether of the compression type or of the non-compression type operating as a thermal siphon system, is obtained by periodically terminating the flow of cooled liquid refrigerant to the evaporator unit and circulating only the fluid in the evaporator unit through a thermal storage reheat unit which is maintained in heated condition during operation of the system for defrosting the evaporator unit. The cold refrigerant normally supplied to the evaporator unit is stored during the defrost cycle for instant supply to the evaporator unit for recooling it at the termination of the defrosting cycle.

18 Claims, 2 Drawing Figures

REFRIGERATION SYSTEM HAVING QUICK DEFROST AND RE-COOL

CROSS REFERENCE TO RELATE APPLICATIONS

This is a continuation-in-part of my prior copending application, Ser. No. 800,075, filed May 24, 1977, now abandoned.

This invention relates to a method and system for quickly and easily defrosting and re-cooling the evaporation unit of a refrigeration system, and is especially useful in a system which operates in accordance with the principles of a thermal siphon without a compressor for the refrigerant.

BACKGROUND OF THE INVENTION

Many of the prior art refrigeration systems are provided with an arrangement for defrosting the evaporator when the latter becomes covered with ice, rendering it inefficient as a cooler. One defrosting arrangement in a compressor type refrigeration system such as disclosed, for example, by the patent to Hoesel U.S. Pat. No. 2,281,770, comprises supplying the refrigerant directly to the evaporator from the compressor through an arrangement which heats the fluid while bypassing the condenser. In this way, the heated refrigerant causes melting of accumulated frost on the evaporator surface. Such defrosting system depends entirely on the operation of the compressor. In a second refrigeration system wherein a compressor is utilized, defrosting of the evaporator is effected by filling a storage device located below the evaporator with cooled liquid refrigerant from the condenser during the cooling cycle. When defrosting is desired, flow of refrigerant from the compressor to the evaporator is terminated, the liquid refrigerant in the storage device is heated to boil off and the vaporized fluid permitted to flow upward to the evaporator in heat exchange relation with the frost accumulated thereon to melt it, the vapor being thus liquified and returned to the storage device by gravity for reheating. Such a system is disclosed in the patent to Lewis U.S. Pat. No. 2,630,685.

In still another compression refrigeration system as disclosed in the patent to Powers et al U.S. Pat. No. 2,628,479, the cooled liquid refrigerant from the condenser is accumulated in a storage tank from which it is pumped directly to the evaporator unit by a liquid pump during the cooling period or through a heat exchanger first, before applying it to the evaporator unit during the defrosting period. The partially vaporized refrigerant from the evaporator unit returns to the storage tank to build up the pressure therein to maintain the refrigerant in the liquid phase.

All of the above prior art systems depend for their refrigerating operation on the standard compressor. Additionally, in U.S. Pat. No. 2,281,770, the compressor is relied upon for feeding hot refrigerant to the evaporator during the defrost cycle. The others of the above mentioned prior art patents, while they do not rely upon the operation of the compressor to furnish hot refrigerant to the evaporator during the defrost cycle, have the disadvantage that a considerable amount of time is required to heat up the cold liquid refrigerant stored in a storage receiver, as it comes from the condenser, before passing it to the evaporator to defrost the latter. Also, when the cooling cycle of the system is commenced, after defrosting the surface of the evaporator unit, a considerable time elapses before the liquid refrigerant is cooled down sufficiently by operation of the compressor system to cause the evaporator to reach the desired low temperature.

ADVANTAGES OF THIS INVENTION

One advantage of this invention over the prior art reside in the fact that defrosting of the evaporator unit and re-cooling same in the desired temperature can be effected more quickly than in the prior art. A further advantage of this invention over the prior art resides in the fact that such fast defrosting and re-cooling can be effected in a refrigeration system operating without the conventional motor-compressor for the refrigerant.

GENERAL DESCRIPTION OF THE INVENTION

The refrigeration system to which my invention is particularly suitable, operates on the principles of a thermal siphon system and which basically comprises two heat exchangers, a first one of which is cooler for condensing the working fluid to its liquid phase and a second one of which is warmer for evaporating the fluid, interconnecting piping, a charge of working fluid and an optional expansion tank for storage of the working fluid as a vapor under non-operating conditions. In normal operation, heat is withdrawn from the working fluid in the first heat exchanger thereby condensing the working fluid, the condensate flowing by gravity to a receiver from which a portion flows by gravity through a control valve to the second or heat absorbing exchanger where it boils and vaporizes due to heat flow from an external source. The resulting vapor returns to be recondensed in the first or heat rejecting exchanger, flow being induced by gravity and the difference of vapor and liquid densities in the system.

In accordance with my invention, when it is desired to quickly warm up the heat absorbing exchanger in order to melt frost and ice accumulated on its surface, the liquid control valve is closed to prevent liquid refrigerant from flowing thereto. A vapor pump, connected to the heat absorbing exchanger, withdraws the vapor and condensate therefrom and feeds them through a thermal storage unit where they are warmed and evaporated and then pumped back to the heat absorbing exchanger to warm it. During the warming period, or during a dwell, vaporized working fluid from the expansion tank connected to the heat rejecting exchanger, is condensed by withdrawing heat from the working fluid by heat rejecting exchanger, the resulting liquid being stored in the receiver. Thus, when a cooling cycle is to take place, the liquid control valve is opened and a portion of the condensed refrigerant liquid flows from the receiver to the heat absorbing exchanger where it rapidly boils off to quickly cool it.

OBJECTS OF THE INVENTION

It is therefore an object of this invention to quickly defrost the surface of the evaporator unit of a refrigeration system by directly heating only the refrigerant within the evaporation unit.

It is a further object of this invention to quickly change the temperature between two limits of a heat absorbing exchanger in a two-phase (liquid-vapor) thermal siphon system.

It is another object of this invention to quickly defrost the evaporator unit of a refrigerator system by directly heating only the refrigerant within the evaporator unit while cooled liquid refrigerant from the condenser is being provided to a storage unit to be immediately available for recooling purposes after the defrost period.

It is a still further object of this invention to provide a refrigeration system in which the condenser provides cooled liquid refrigerant to a storage unit while its evaporator unit is being heated in order to be immediately available for passage to the evaporating unit for cooling its environment.

DETAILS OF THE INVENTION

Figure 1:
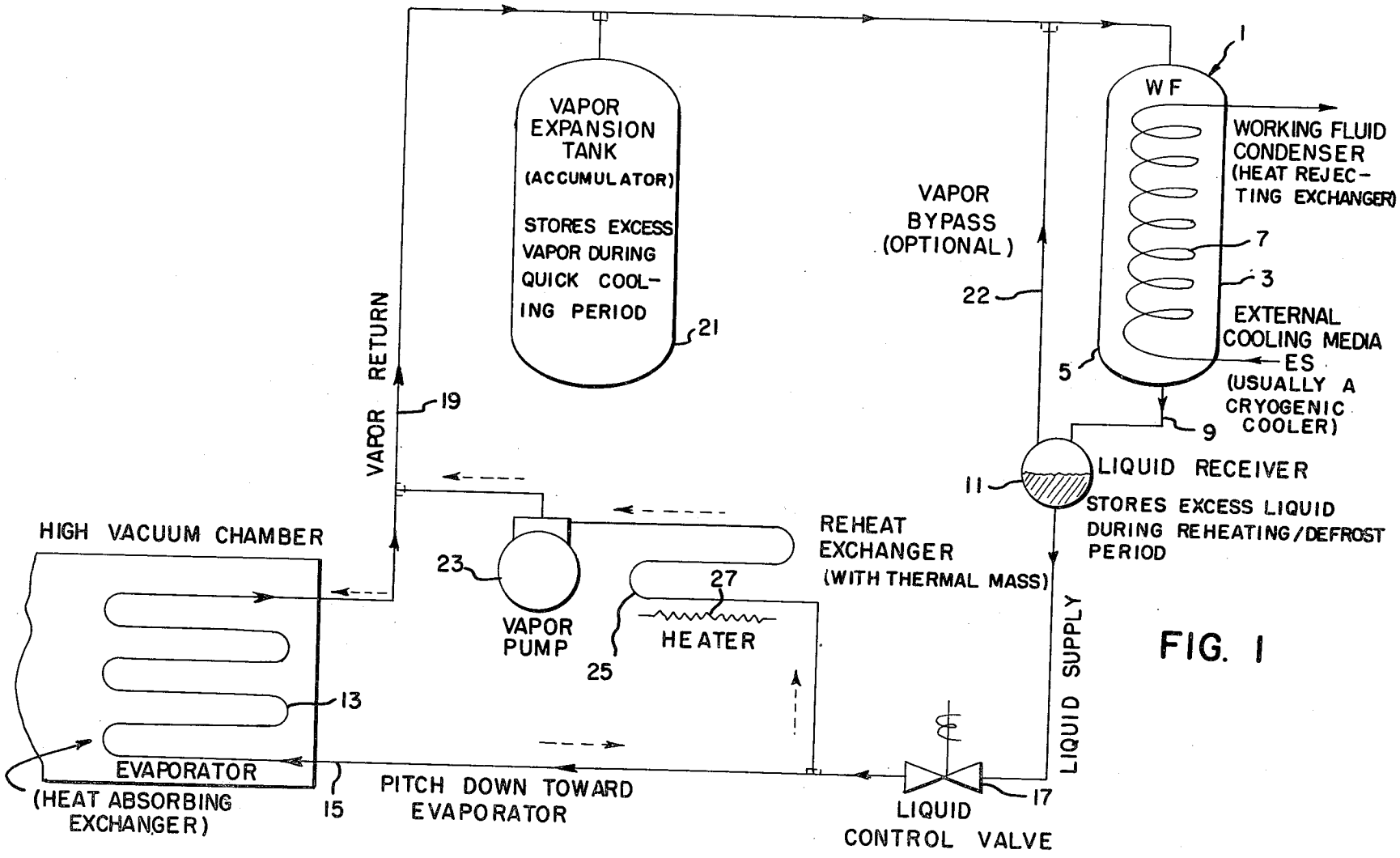
FIG. 1 is a schematic drawing of a first embodiment of the present invention.

With the above and further objects which will become apparent as the description of the invention proceeds, FIG. 1 of the drawings illustrates in diagrammatic form the invention as applied to a refrigeration system operating on the thermal siphon principle and without the use of the conventional motor-compressor. A first heat exchanger 1 comprises a shell 3 forming a hollow chamber 5 having within its space heat exchanger coil 7. Connected to the lower end of the shell 3 as by a conduit 9 is a liquid receiving vessel 11. An evaporator unit 13, forming the second heat exchanger, is connected at one end to the lower end of the receiver 11 by conduit 15 through a liquid control valve 17 and at its other end by a return conduit 19 to the shell 3 above the lower end thereof. The closed system just described, receives a charge of the refrigerant working fluid, WF, in vapor form. Optionally, a vapor expansion tank 21 having an opening may be connected at said opening to the return conduit 19 for storage of the fluid under non-operating conditions. An optional vapor by-pass conduit 22 may be provided between the liquid receiver 11 and the upper part of the shell 3, as shown.

In normal operation, coolant from an external source ES circulates in heat exchanger coil 7 to absorb the heat from the refrigerant working fluid WF to cause it to condense in chamber 5. The condensate then flows by gravity into the liquid receiver 11 from which a portion of it flows further by gravity through normally open liquid control valve 17 to the second heat exchanger comprising evaporator coil 13 in which it boils by absorbing heat from the environment in which the coil is located. The resulting vapor flows back to the first heat exchanger 1 to be recondensed therein. Flow of the vapor and condensate in the system, as shown by the solid arrows, is induced by gravity and the difference of liquid and vapor densities in the system. A vapor pump 23 is connected between the ends of the evaporator coil 13 by means of a conduit having a portion 25 in heat exchange relation with a thermal storage mass represented by the numeral 27 and forming a reheat and/or reevaporation unit. The thermal storage is maintained continuously heated during operation of the system as a whole.

When it is desired to quickly warm up the heat absorbing exchanger 13, the liquid control valve 17, which may be operated by a solenoid, is closed to prevent condensate from flowing to the heat absorbing exchanger 13 and operation of the vapor pump 23 is initiated. The colder vapors and condensate in the second heat exchanger 13 are drawn through the reheat and/or re-evaporation unit 25 where they are warmed and evaporated then pumped back to the second heat exchanger 13 to warm it. Circulation of the fluid during the defrost cycle is shown by the dotted arrows. Upon the heat absorbing exchanger 13 reaching a desired warm temperature, operation of the vapor pump is terminated. During the period of warming the second heat exchanger or evaporation unit 13, or during a dwell period thereafter and before liquid valve 17 is reopened, heat is withdrawn by the heat rejection exchanger 1 from the working fluid vapors which are drawn from the vapor expansion tank 21 and the resulting condensate is stored in the liquid receiver 11.

When it is desired to quickly cool or re-cool the heat absorbing exchanger 13 to its normal cold operating level, the liquid control valve 17 is opened to permit flow of the stored condensate into the exchanger 13 from the receiver and to rapidly boil off to quickly cool the exchanger, the operation of the refrigeration system thus returning to normal. The cycle above described may be repeated as frequently as desired, the results to be obtained in the warming cycle being limited only by the thermal storage mass and heater capacity for reheating the refrigerant fluid and, in the cooling cycle, by the heat withdrawing capacity at the heat rejecting exchanger 1 and the expansion tank and liquid receiver sizes for quick re-cooling.

A most important application of my invention lies in such high vacuum production processes as coating or freezing drying and which have large vapor loads which can best be handled by cryopumping as close to the vapor source as possible. Such cryopumping is accomplished by using a cryocoil mounted directly in a vacuum chamber. This arrangement requires the cryosurface to be quickly cooled for each evacuation cycle and promptly warmed to room temperature each time the chamber is to be opened. This warming of the cryocoil surface prevents the condensation of water vapor from the ambient air onto the coil and which freezes during the cooling cycle.

The working fluid or refrigerant most commonly used in the above described system for operation in a cryogenic temperature range in Refrigerant-14 (tetrafluoromethane) from about −150° C. to −80° C. Alternatively, Refrigerant-503 (an azeotrope of R-13 and R-23) is readily usable over a range of −140° C. to −70° C., or Refrigerant-13 (chlorotrifluoromethane) from −140° C. to −50° C. The above mentioned R-23 is trifluoromethane. Other halocarbons or fluorocarbons can easily be used, but selection is based upon desirable thermophysical characteristics and the design operating temperature range. In a specific instance, the performance of my quick cool-defrost system as hereinabove described utilizing a properly matched condenser or first heat exchanger and cryocoil or second heat exchanger, the cryosurface was cooled down from a ambient temperature of 20° C. to −120° C. or colder within five to seven minutes. The cryosurface was also warmed from −120° C. or colder to at least 25° C. within five to seven minutes. The total heating and cooling time involved during a production run should be about forty minutes, to allow for recovery of the thermal storage system 25.

Figure 2:
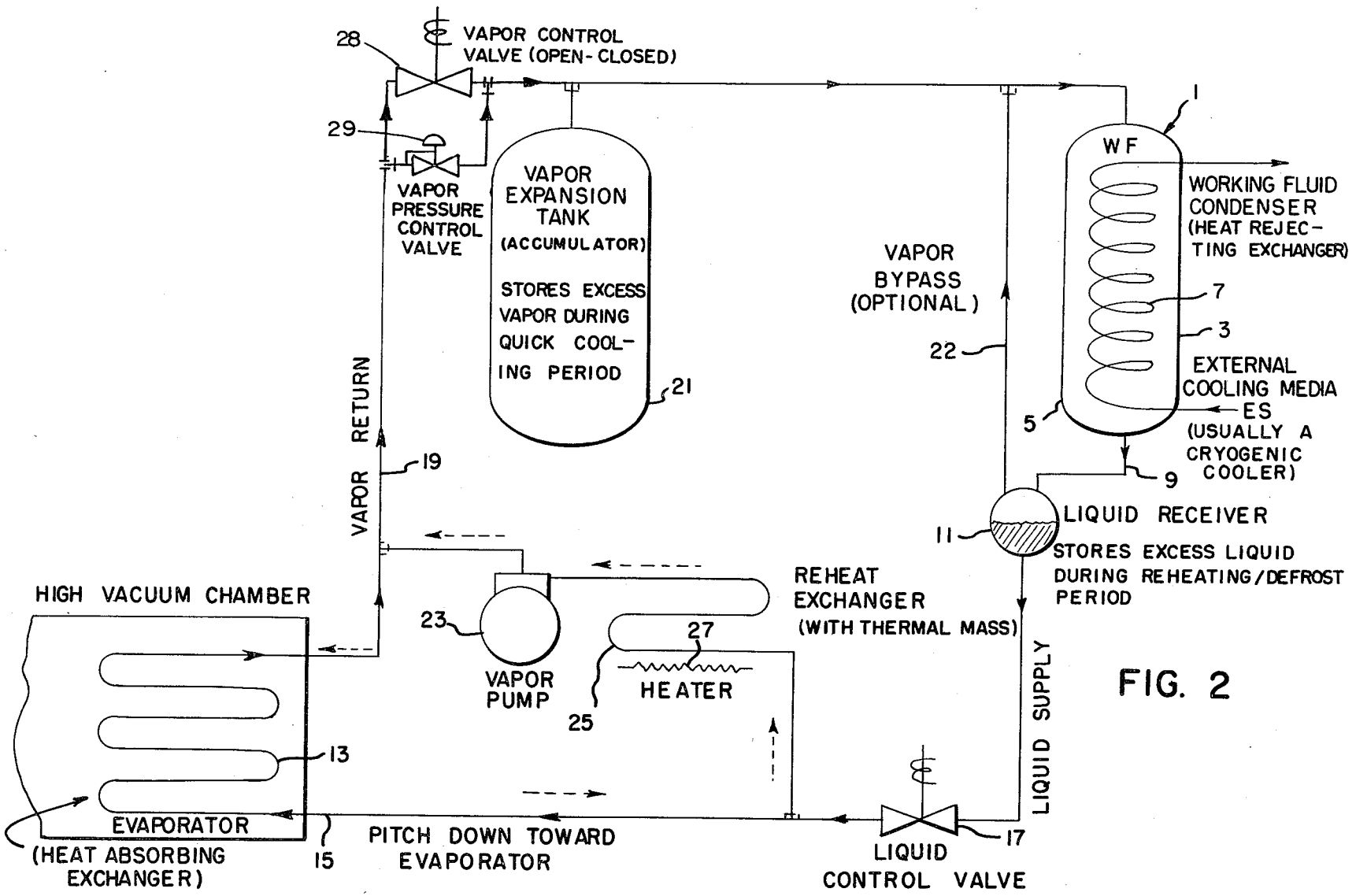
FIG. 2 is a schematic drawing of a second embodiment of the present invention.

I have found that the rate of defrosting the evaporator unit 13 in the manner above described, may be greatly increased by inhibiting flow of the fluid being circulated through the evaporator to the refrigerant storage vessel 21. To this end, a valve such as 28, as shown in FIG. 2 may be provided in the vapor return 4, line 19, between the junction of the pump and evaporator unit and tank 2 to isolate the internal volume of the tank from the evaporator unit 13 and the vapor pump 23 during the defrosting operation. Defrost time with the valve 28 closed can thus be reduced from a five to seven minute period with the valve open down to one to two minutes with equivalent apparatus sizes and temperature ranges in each case. Also, the utilization of this valve at the described location eliminates the adverse effect defrosting the evaporator has upon the storage of cooling effect during defrosting. The liquid which is vaporized in the evaporator upon initiation of the defrost cycle and which creates a higher pressure, is contained at this higher pressure in this portion of the circuit. It is isolated from the other portion of the circuit which is concurrently storing cooling effect. During the normal cooling cycle the valve 28 is open and may be manually controlled or operated by remote control.

A second valve 29 which may be of the pressure responsive type is connected in parallel with the valve 28 to open in order to bypass the latter when a predetermined pressure level of the fluid in line 19 is reached. The valve 29 may also be of the type operated by remote control in response to actuation by a pressure sensor in line 19.

Because, during defrost, the pressure in the isolated evaporator portion of the circuit can be readily controlled at levels from three to six or more times that of the system without such valves, the vapor pump can move gases at densities proportionally greater. This results in heat being transported from the reheat and/or reevaporation unit 25 (thermal storage unit) to the evaporator at much greater rates. The relationship is not linear. A fourfold increase in density will shorten the defrost time to about one-third as much.

With this isolation during defrost, the external cooling media can continue to condense the working fluid in heat exchanger 1 at lower pressures, withdrawing vapors from vapor expansion tank 21 and storing the condensate in liquid receiver 11, without affecting this cooling process even with a higher pressure in evaporator 13.

The above described quick defrost system is also useful in a winter heat recovery system (thermal siphon type) for space air conditioning, where the heat rejection exchanger or condenser is used for preheating the entering outside air and the heat absorbing exchanger or evaporator coil draws heat from the air exhausted from within. Defrosting of the latter may be accomplished in the manner heretofore described.

Although my above described quick cool-defrost system is described in conjunction with a thermal siphon system, its teachings indicate that it may also be used to advantage in a refrigeration system of the motor-compressor type. In such a system, a heat storage unit may be provided so that when it is desired to defrost the evaporator unit, the latter may be isolated from the compressor and condenser by cut-off valves and a vapor pump rendered effective to circulate vapor and condensate from the evaporator unit only through the heat storage unit for reheating and/or vaporizing the refrigerant. When the evaporator unit has been warmed to the desired temperature, it can be reconnected to the compressor, the vapor pump discontinued and the stored liquid condensate from the condenser immediately fed to the evaporator unit to cool it.

Having thus described my invention the best mode of using it, it should be understood that various changes and modifications may be made by persons skilled in the art without departing from the spirit and scope of this invention as defined by the appended claims.

What is claimed is:

1. In a refrigeration system having condenser means for cooling and condensing a refrigerant vapor to the liquid phase, an evaporator unit for receiving a flow of said liquid condensate to be cooled thereby and upon which ice forms by condensation of humidity in the surrounding space or atmosphere and from which the refrigerant normally returns to the condenser means in its vapor phase, a storage tank comprising a source for the refrigerant vapor connected to the condenser means, means for quickly defrosting the evaporator unit comprising:

means for terminating flow of said cooled liquid condensate from the condenser means to the evaporator unit without terminating operation of said condenser means, a thermal storage unit, a vapor pump connected directly to the evaporator unit for circulating only the fluid therein in heat exchange relation with said thermal storage unit for reheating and vaporizing the fluid therein to quickly warm the evaporator unit, said thermal storage unit being continuously heated during the defrosting and cooling operations of the evaporator unit.

2. In a refrigeration system according to claim 1, including valve means for inhibiting flow of said circulating fluid to said storage tank during operation of said pump to defrost the evaporator unit.

3. In a refrigeration system according to claim 2 further including means responsive to a predetermined fluid pressure level in said evaporator unit during operation of said pump to defrost the evaporator unit for bypassing said valve means to permit flow of said circulating fluid to said storage tank.

4. In a refrigeration system as in claim 3, including storage means in the flow path of the condensate between the condenser and evaporator unit for intercepting and storing a quantity of said condensate, said means for terminating flow of said condensate to the evaporator unit comprising a control valve between the storage means and evaporator unit.

5. In a refrigeration system as in claim 1, including storage means in the flow path of the condensate between the condenser and evaporator unit for continuously storing a plurality of said condensate, said means for terminating flow of said condensate to the evaporator unit comprising a control valve between the storage means and evaporator unit.

6. In a refrigeration system according to claim 5, including valve means for inhibiting flow of said circulating fluid to said storage tank during operation of said pump to defrost the evaporator unit.

7. In a refrigeration system through which refrigerant circulates according to the principles of a thermosiphon without the use of a compressor, said system having a condenser provided with an inlet and an outlet for cooling and condensing a refrigerant vapor to its liquid phase, an evaporator unit having an inlet and an outlet located at a level below the condenser, a closed loop comprising a passageway connecting the outlet of the condenser to the inlet of the evaporator unit for flow of refrigerant liquid thereto by gravity to cool it and a second passageway between the outlet of the evaporator unit and the inlet of the condenser unit for return of refrigerant vapor thereto from the evaporator unit, the flow of said refrigerant in said loop being induced by gravity and the difference of vapor and liquid densities in the system, a source of refrigerant in its vapor phase connected to the inlet of said condenser, means for selectively warming said evaporator unit comprising a continuously heated unit, means for terminating flow of the liquid refrigerant to the evaporator unit from the condenser without terminating operation of the condenser, and pump means connected directly to the evaporator unit between its outlet and inlet for circulating the fluid therein in heat exchange relation with said heated unit.

8. In a refrigeration system according to claim 7 including valve means for inhibiting flow of said circulating fluid to said source of refrigerant during operation of said pump to defrost the evaporator unit.

9. In a refrigerator system according to claim 8 further including means responsive to a predetermined fluid pressure level in said evaporator unit during operation of said pump to defrost said unit for bypassing said valve means to permit flow of said circulating fluid to said source of refrigerant.

10. In a refrigerant system according to claim 9 in which said source comprises a refrigerant vapor storage tank.

11. In a refrigeration system according to claim 10 further including storage means in the flow path of the condensate between the condenser and evaporator unit for continuously storing a quantity of said condensate, said means for terminating flow of said condensate to the evaporator unit comprising a control valve between the storage means and evaporator unit.

12. In a refrigeration system according to claim 7 in which said source comprises a refrigerant vapor storage tank.

13. In a refrigeration system according to claim 12 further including storage means in the flow path of the condensate between the condenser and evaporator unit for continuously storing a quantity of said condensate, said means for terminating flow of said condensate to the evaporator unit comprising a control valve between the storage means and evaporator unit.

14. In a refrigeration system according to claim 12 including valve means for inhibiting flow of said circulating fluid to said source of refrigerant during operation of said pump to defrost the evaporator unit.

15. In a refrigerant system according to claim 14 further including storage means in the flow path of the condensate between the condenser and evaporator unit for continuously storing a quantity of said condensate, said means for terminating flow of said condensate to the evaporator unit comprising a control valve between the storage means and evaporator unit.

16. In a refrigeration system according to claim 7 further including storage means in the flow path of the condensate between the condenser and evaporator unit for continuously storing a quantity of said condensate, said means for terminating flow of said condensate to the evaporator unit comprising a control valve between the storage means and evaporator unit.

17. In a refrigeration system according to claim 16 including valve means for inhibiting flow of said circulating fluid to said source of refrigerant during operation of said pump to defrost the evaporator unit.

18. In a refrigeration system according to claim 17 further including means responsive to a predetermined fluid pressure level in said evaporator unit during operation of said pump to defrost said unit for bypassing said valve means to permit flow of said circulating fluid to said source of refrigerant.

* * * * *